US005655980A

United States Patent [19]

Nashif et al.

[11] Patent Number: 5,655,980

[45] Date of Patent: Aug. 12, 1997

[54] VIBRATION DAMPING DEVICE FOR SPORTING IMPLEMENTS

[75] Inventors: Ahid D. Nashif, Cincinnati, Ohio; Gopichand Koganti, Sunnyvale, Calif.

[73] Assignee: Roush Anatrol, Inc., Sunnyvale, Calif.

[21] Appl. No.: 551,990

[22] Filed: Nov. 2, 1995

Related U.S. Application Data

[63] Continuation-in-part of Ser. No. 484,451, Jun. 7, 1995 .

[51] Int. Cl.[6] ..... A63B 49/00

[52] U.S. Cl. ..... 473/520

[58] Field of Search ..... 273/73 R, 73 C, 273/73 G, 73 J; 473/519, 520, 521, 522, 523

[56] References Cited

U.S. PATENT DOCUMENTS

| | | | |
|---|---|---|---|
| 3,941,380 | 3/1976 | Lacoste . | |
| 4,541,631 | 9/1985 | Sasse . | |
| 4,609,198 | 9/1986 | Tarr . | |
| 4,627,635 | 12/1986 | Koleda | 273/735 X |
| 4,690,405 | 9/1987 | Frolow . | |
| 4,811,947 | 3/1989 | Takatsuka et al. | 273/735 |
| 4,826,167 | 5/1989 | Lo . | |
| 4,875,679 | 10/1989 | Movilliat et al. | 273/735 X |
| 4,909,509 | 3/1990 | Boschian . | |
| 4,948,131 | 8/1990 | Nakanishi . | |
| 4,951,948 | 8/1990 | Peng . | |
| 5,039,096 | 8/1991 | Chen . | |
| 5,092,594 | 3/1992 | Jang . | |
| 5,104,123 | 4/1992 | Okitsu et al. . | |
| 5,131,652 | 7/1992 | Peng . | |
| 5,141,228 | 8/1992 | Soong . | |
| 5,180,163 | 1/1993 | Lanctot et al. . | |
| 5,219,164 | 6/1993 | Peng . | |
| 5,236,198 | 8/1993 | Haines et al. . | |
| 5,242,724 | 9/1993 | You . | |
| 5,269,516 | 12/1993 | Janes . | |
| 5,282,618 | 2/1994 | Hong . | |
| 5,303,917 | 4/1994 | Uke . | |
| 5,314,180 | 5/1994 | Yamagishi et al. . | |
| 5,322,280 | 6/1994 | Wu . | |
| 5,362,046 | 11/1994 | Sims . | |
| 5,374,057 | 12/1994 | Lai et al. . | |
| 5,380,003 | 1/1995 | Lanctot . | |
| 5,409,218 | 4/1995 | You . | |
| 5,454,562 | 10/1995 | Sommer . | |
| 5,511,777 | 4/1996 | McNeely . | |

*Primary Examiner*—William E. Stoll
*Attorney, Agent, or Firm*—Bliss McGlynn, P.C.

[57] ABSTRACT

A vibration damping device for sporting implements includes a base member and a mass mounted to the base member and cantilevered relative thereto, the device is tuned such that it vibrates at the same frequency as the sporting implement but out of phase therewith.

7 Claims, 5 Drawing Sheets

FIG 1
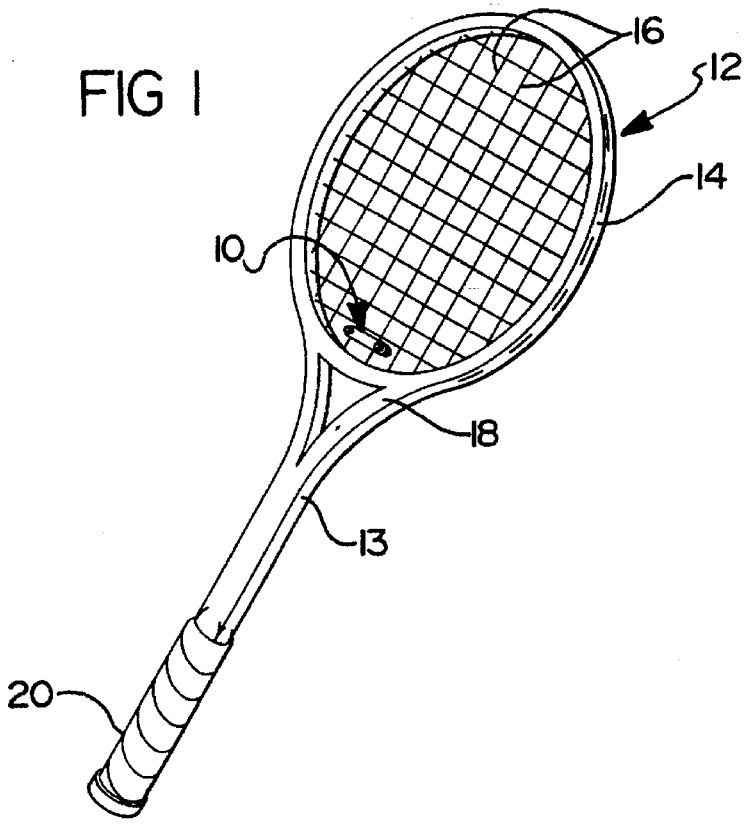
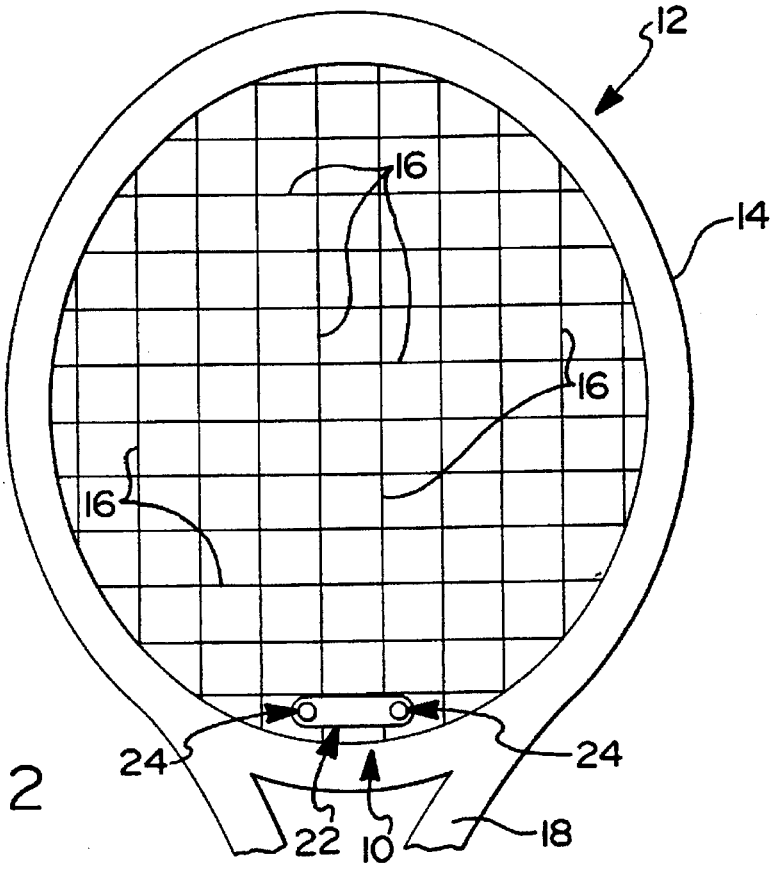
FIG 2

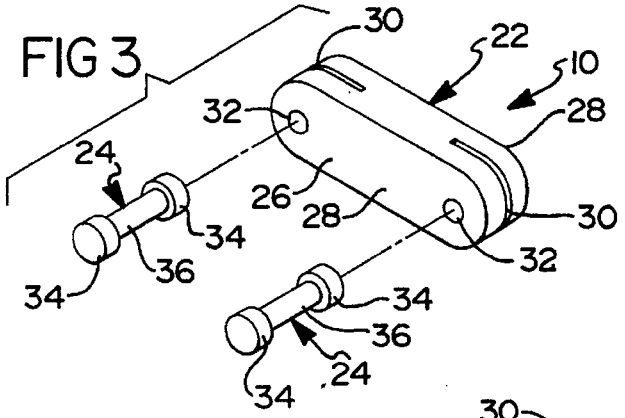
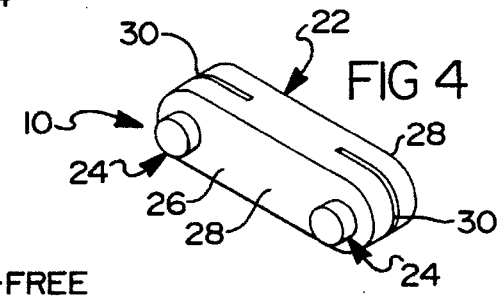
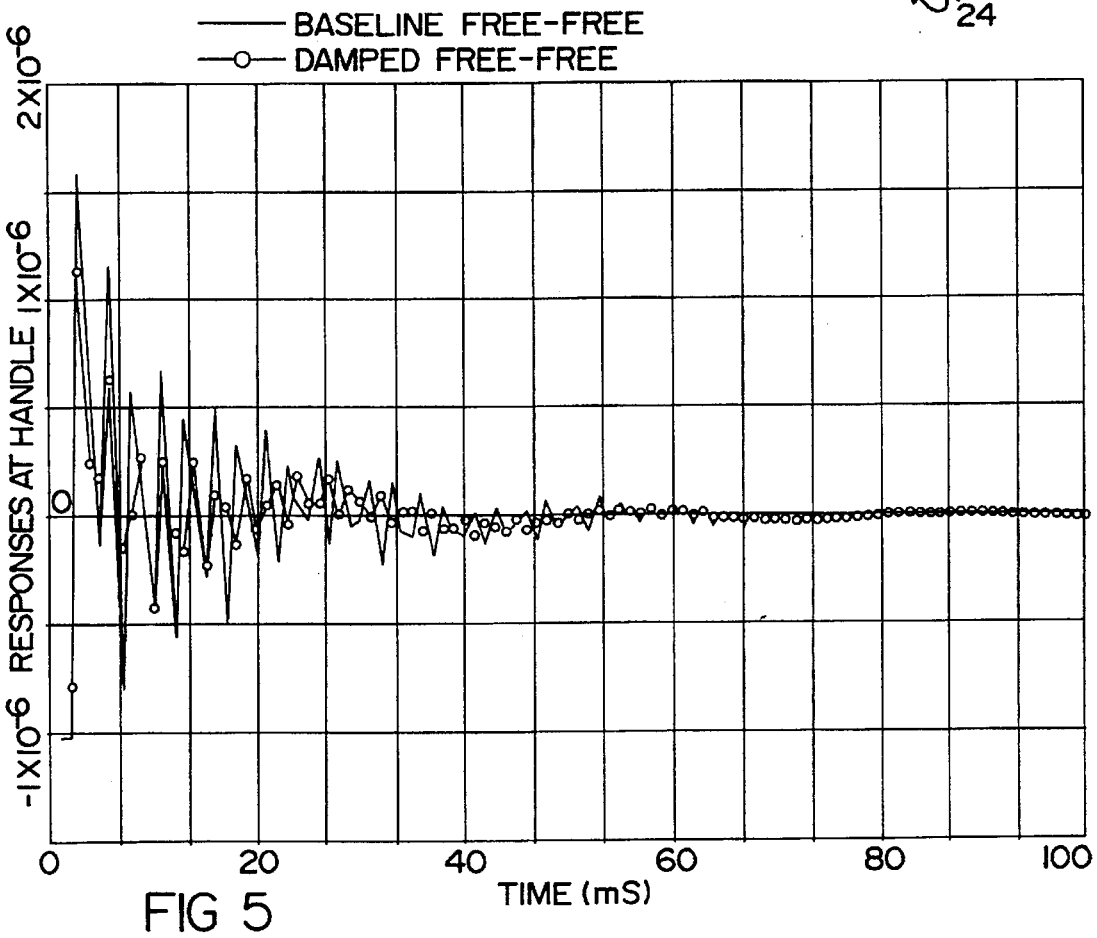
FIG 5

FIG 7
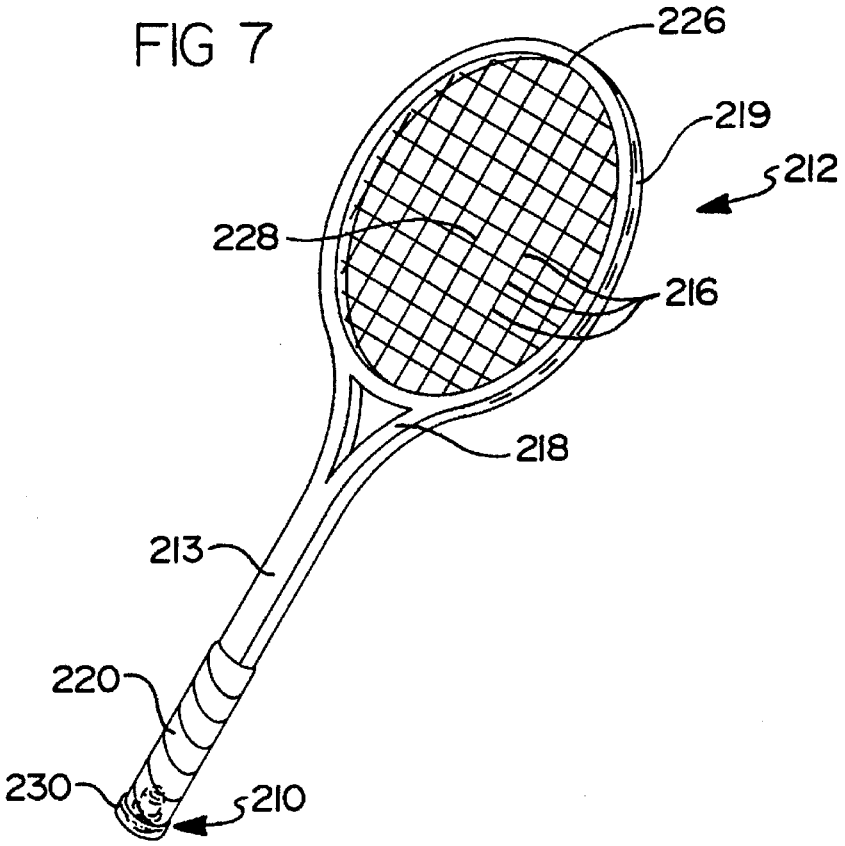
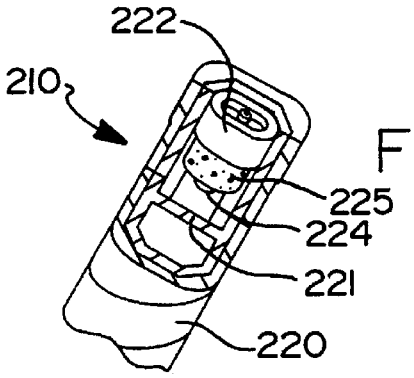
FIG 8
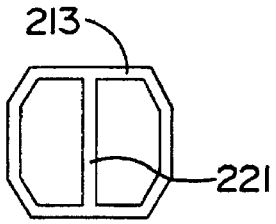
FIG 9

FIG 10
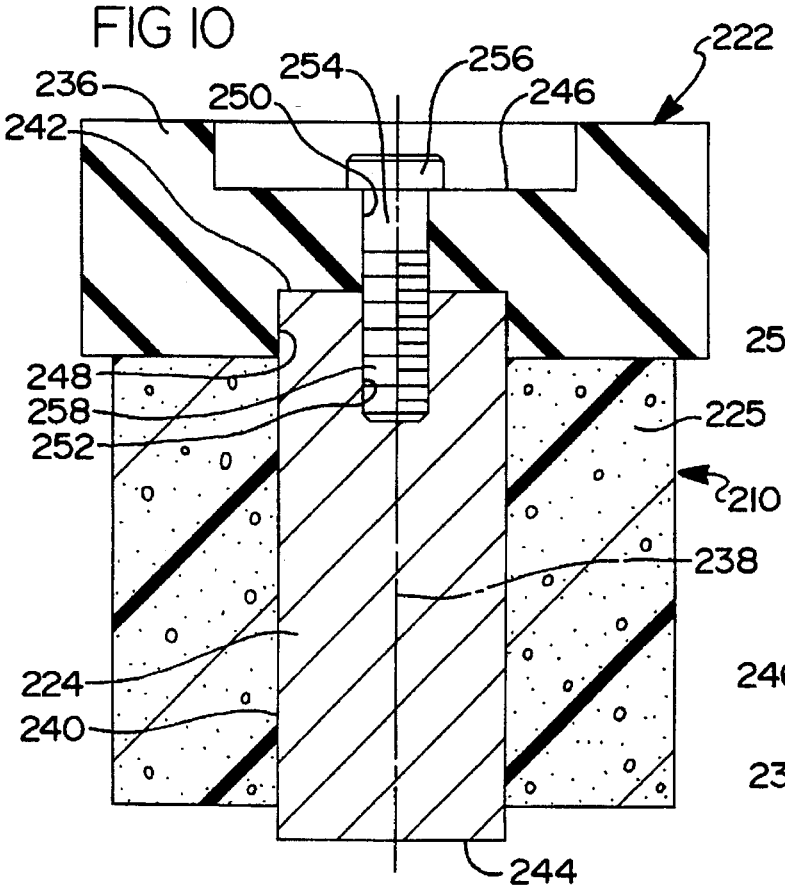
FIG 11
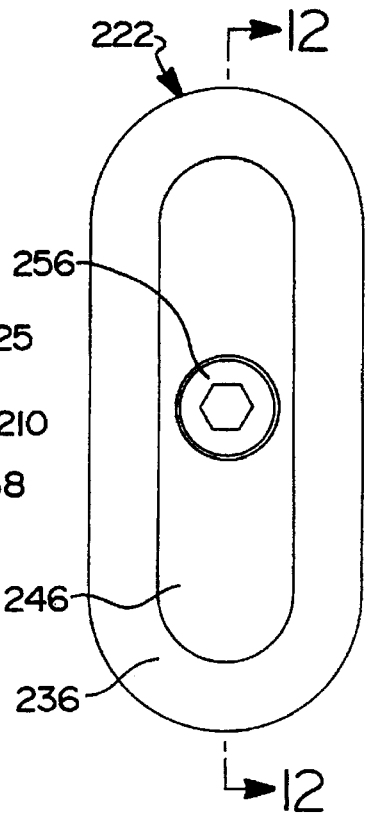
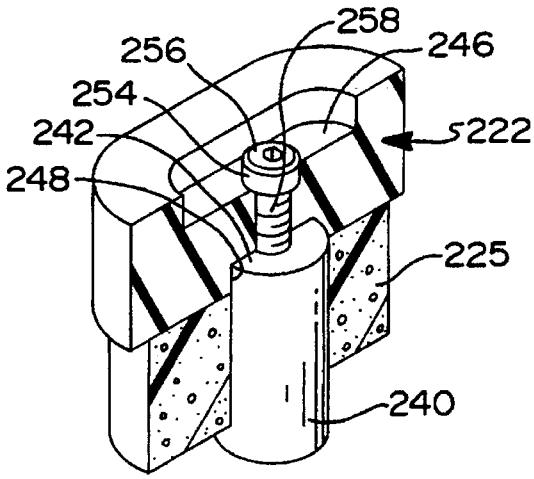
FIG 12

VIBRATION DAMPING DEVICE FOR SPORTING IMPLEMENTS

CROSS-REFERENCE TO RELATED APPLICATION

This is a continuation-in-part of U.S. Ser. No. 08/484,451, filed on Jun. 7, 1995, pending, entitled "Vibration Damping For Stringed Racquets".

BACKGROUND OF THE INVENTION

1. Field of the Invention

The present invention relates generally to vibration damping devices and, more specifically, to vibration damping devices for sporting implements.

2. Description of the Related Art

The popularity of sports involving sporting implements, such as golf, tennis, hockey, and racquet ball, continues at a strong pace. Better engineering, better materials, lighter, stronger implements with larger heads and more power have improved the play of games with these implements and thereby increased the enjoyment associated therewith. Although these implements have worked well, they suffer from the disadvantage that despite improvements in other areas the unwanted vibratory phenomena generated upon an impact with a ball which is not dead center in the "sweet spot" of the implement remains.

Lighter implements have allowed players to swing harder at the ball. Larger implements, while increasing the "sweet spot" on the face thereof, have also increased the area outside the "sweet spot", providing increased opportunity for imperfect or offset contact with the ball.

Vibrations are introduced into the implement due to the impact the ball creates on the face of the implement. At impact, the velocity of the ball transfers its energy into the face and the face, in turn, pass it onto the handle of the implement. The sweet spot of the implement is the point of minimum vibration. When the ball is hit perfectly, in the center of the sweet spot, the vibrations generated do not negatively affect the player and even give a distinctive, pleasant sound confirming the quality of the player's stroke.

On the other hand, when the ball is hit off center, this condition creates imbalanced forces and generates vibrations. Ideally, and in the absence of a damping medium, the vibrations would continue for an infinite time. Unfortunately, the human arm, which grasps the implement, is a good damping medium and absorbs this energy. The energy absorbed by the human arm is dissipated in the form of pain and tiredness.

Vibration dampers/absorbers for sporting implements are now commercially available. Commercial dampers presently available primarily help in reducing noise generated in connection with an off center contact with the ball but contribute little to the reduction of vibrations in the implement which are ultimately damped by the human arm.

SUMMARY OF THE INVENTION

It is, therefore, one object of the present invention to provide a vibration damping device for a sporting implement.

It is another object of the present invention to provide a vibration damping device for a sporting implement which effectively cancels the vibration generated by unbalanced forces due to an off center contact with a ball.

To achieve the foregoing objects, the present invention is a vibration damping device for a sporting implement including a base member and a mass mounted to the base member and cantilevered relative to the base member. The device is tuned such that it vibrates at the same frequency as the sporting implement but out of phase therewith.

One advantage of the present invention is that a vibration damping device is provided for a sporting implement in which the device itself is a vibrating system. Another advantage of the present invention is that the vibration damping device vibrates at the same frequency as the sporting implement. Yet another advantage of the present invention is that the sporting implement and vibration damping device vibrate at the same frequency and in a phase opposite to each other to cancel out each other and the resultant responses in the sporting implement are reduced by a significant amount. A further advantage of the present invention is that the vibrations transmitted into the sporting implement are greatly reduced and the human arm tends to absorb much less energy and effectively increases the sweet spot areas of the implement significantly.

Other objects, features and advantages of the present invention will be readily appreciated as the same becomes better understood after reading the subsequent description taken in conjunction with the accompanying drawings.

BRIEF DESCRIPTION OF THE DRAWINGS

FIG. 1 is a perspective view of a stringed racquet including a vibration damping device, according to the present invention.

FIG. 2 is a partial front view of the stringed racquet and the vibration damping device of FIG. 1.

FIG. 3 is an exploded view of the vibration damping device of FIGS. 1 and 2.

FIG. 4 is a perspective view of the vibration damping device of FIGS. 1 and 2.

FIG. 5 is a graph comparing relative frequency responses at handle between an undamped stringed racquet and a damped stringed racquet employing the vibration damping device according to the present invention.

FIG. 7 is a perspective view of a sporting implement including a vibration damping device according to the present invention.

FIG. 8 is a partial fragmentary view of a portion of the sporting implement and the vibration damping device of FIG. 7.

FIG. 9 is sectional view of a portion of the sporting implement of FIG. 7.

FIG. 10 is sectional view of the vibration damping device of FIGS. 7 and 8.

FIG. 11 is a plan view of the vibration damping device of FIG. 10.

FIG. 12 is sectional perspective view taken along line 12—12 of FIG. 11.

DESCRIPTION OF THE PREFERRED EMBODIMENT(S)

Figure 6:
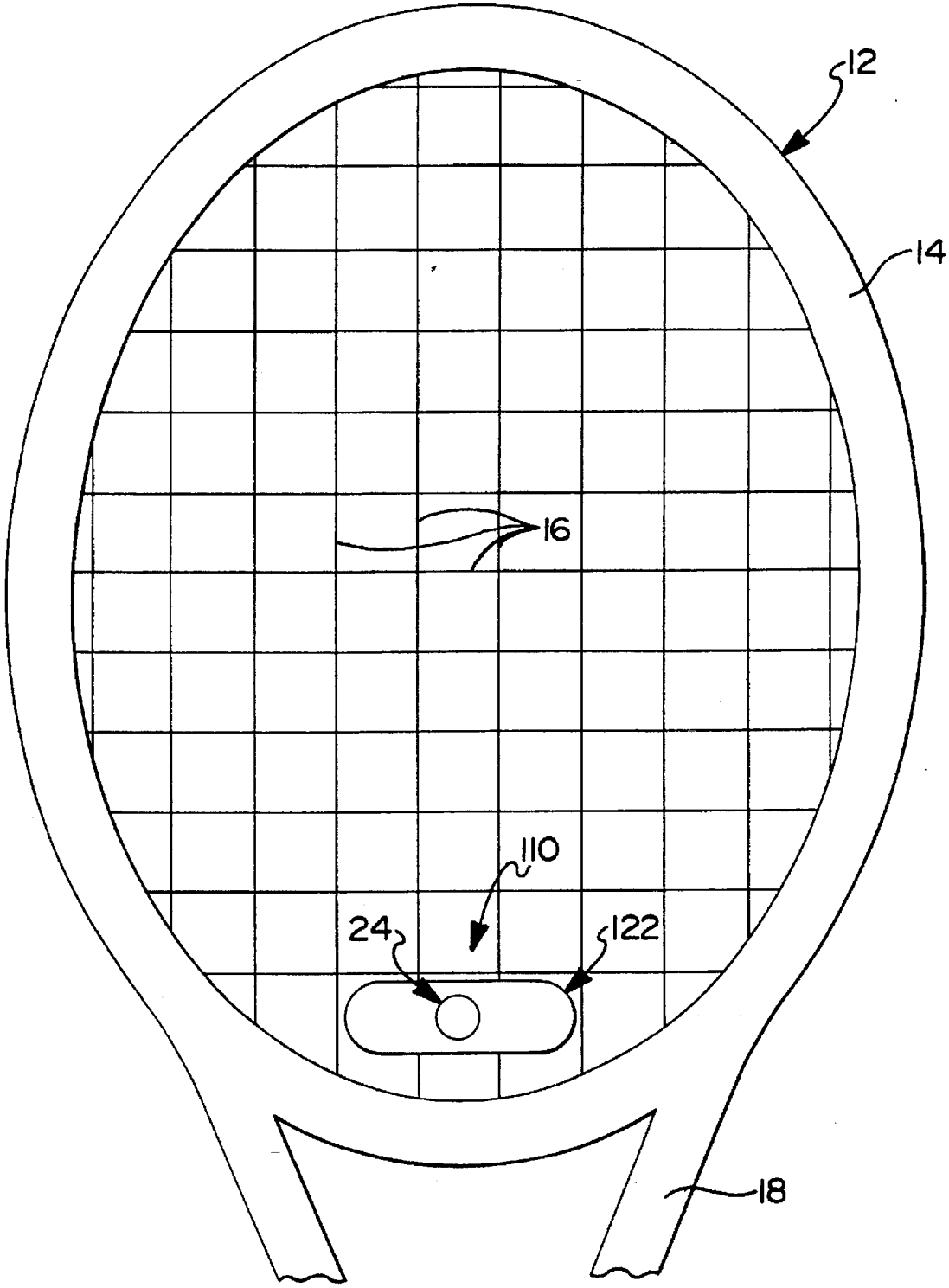
FIG. 6 is partial front view of a stringed racquet including another vibration damping device, according to the present invention.

Referring to the drawings and in particular to FIG. 1, one embodiment of a vibration damping device 10, according to the present invention, is shown for stringed implements or racquets such as a tennis racquet, generally indicated at 12. The vibration damping device 10 may be employed to reduce vibrations in any stringed racquet but is particularly adapted for use with tennis or racquetball racquets. While the vibration damping device 10 is shown in connection with a tennis racquet 12, it should be appreciated that this is by way of illustration and not by way of limitation. Such racquets 12 generally include a racquet frame 13 having a head 14, strings 16, a throat 18 and a handle 20 as is known in the art.

Referring to FIGS. 1 through 4, the vibration damping device 10 includes a viscoelastic member, generally indicated at 22, which is adapted to be mounted between the strings 16 of the racquet 10. The viscoelastic member 22 is ideally mounted low on a face of the racquet 12 near the throat 18. However, it should be appreciated that the vibration damping device 10 may be mounted at any position on the face of the racquet 12 which would not otherwise interfere with play.

The vibration damping device 10 also includes at least one movable mass or member, generally indicated at 24, carried on the viscoelastic member 22. The moveable member 24 is movable relative to the viscoelastic member 22 in response to vibrations induced by an impact on the strings 16 of the racquet 12 such that the vibration damping device 10 vibrates over the same frequency range but out of phase with the racquet 12 to dampen vibrations in the racquet 12. More specifically, and in one embodiment, the vibration damping device 10 vibrates at the same frequencies as the racquet 12 but one hundred eighty degrees (180°) out of phase with the racquet 12.

The viscoelastic member 22 includes a body 26 which is made of a viscoelastic material with appropriate modulus and damping values. The body 26 has a pair of opposed flat sides 28 and a pair of slots 30 disposed opposite one another on the body 26 and interposed between the flat sides 28. The pair of slots 30 are adapted to receive a pair of the strings 16 on the racquet 12 to mount the vibration damping device 10 thereto. The body 26 includes at least one aperture 32 extending through the body 26 between and substantially perpendicular to the opposed flat sides 28. It should be appreciated that the body 26 may have any suitable shape such as rectangular, circular, oval, diamond or star.

The movable member 24 extends through the aperture 32 and on either side of the body 26 of the viscoelastic member 22. More specifically, and in one embodiment, the body 26 includes a pair of apertures 32 spaced relative to one another and extending between the pair of opposed flat sides 28. In one embodiment, the vibration damping device 10 includes a pair of movable members 24. Each movable member 24 is a weight made of metal including a pair of enlarged head portions 34 and a connecting portion 36 extending between the head portion 34 and through each of the apertures 32. Each member 24 is movable relative to the body 26 in the apertures 32 in a direction perpendicular to the face of the racquet 12. Each of the enlarged heads 34 on the movable members 24 are disposed adjacent to the pair of opposed flat sides 28 of the body 26. It should be appreciated that the enlarged head portions 34 of the movable members 24 are pushed through the apertures 32 such that the connecting portion 36 extends through the apertures 32 in the body 26 and the enlarged head portions 34 of the movable members 24 are disposed on both sides of the body 26.

The pair of slots 30 extend perpendicular to and intersect with the pair of apertures 32 such that the strings 16 of the racquet 12 are located between the pair of movable members 24 in the opposed slots 30 when the vibration damping device 10 is mounted to the racquet 12 as shown in FIGS. 1 and 2.

The vibration damping device 10, according to the present invention, functions as a tuned vibration absorber which acts instantaneously as the impact of the ball is being imparted to the racquet 12. The vibration damping device 10 vibrates at the same frequency as the fundamental bending mode of the racquet frame 13 and in a phase opposite to the frame vibration. The vibration of the vibration damping device 10 in opposite phase helps in canceling the vibration of the racquet frame 13. Thus, the vibration damping device 10 of the present invention effectively reduces the unwanted, excessive energy transmitted to the holder of the racquet 12.

Referring to FIG. 5, the time responses in the frequency between an undamped tennis racquet and a damped tennis racquet are compared. The peak amplitude of the frequency on the damped system is reduced into two smaller amplitude levels. As the peak amplitude is reduced by almost a factor of ten (10), the time required to damp out the vibrations will proportionally be reduced. The absorption of excessive energy levels results in a reduction in the energy absorbed by the human body and thus reduces pain and tiredness in the holder's arm.

The vibration damping device 10 of the present invention is tuned to the fundamental bending mode frequency of any racquet by (1) varying the distance between the center of the mass and the string to which the vibration damping device 10 is attached and/or (2) varying the mass, and/or (3) varying the stiffness properties of the viscoelastic member, and/or (4) the cross section of the body 26 of the viscoelastic member 22. Thus, the vibration damping device 10 of the present invention acts as a cantilever beam cantilevered at the strings 16. The equations governing the frequency of a cantilever beam are as follows:

The stiffness for a transverse vibration is given by $$k = 3\frac{EI}{\beta}$$

where E is the modulous of elasticity, l is the length of the body 26 and I is the moment of inertia defined as:

$$\frac{bh^3}{12}$$

and is dependent upon the height and thickness of the body 26 of the viscoelastic member 22.

The equivalent mass of the system is defined as $$M_{eq}=M_{sprung}+0.23\ m_{rubber}$$

The frequency of this system is defined as $$\frac{1}{2\Pi}\sqrt{\frac{k}{M_{eq}}}$$

By varying E, l, b, h and M the required frequency can be obtained for the vibration damping device 10 of the present invention. For example, the total weight of the moveable member 24 ranges from 2.1 grams to 3.2 grams, the height and thickness of the body 26 may be 0.25 and 0.4 inches, respectfully, and the length of the body 26 ranges from 0.95 to 1.45 inches. As a result, the vibration damping device 10 has a frequency range, for example, of approximately 125 Hz to 210 Hz.

Referring to FIG. 6, another vibration damping device 110 is shown for the racquet 12. Like parts of the vibration damping device 10 have like reference numerals increased by one hundred (100). The vibration damping device 110 has a single moveable member 24 and is mounted to the strings 16 such that the moveable member 24 is suspended between the strings 16. This type of vibration damping device 110 acts as a fixed-fixed beam whose stiffness (k) is sixteen (16) times the stiffness of a cantilever beam and is given by:

$$k = 48\frac{EI}{\beta}$$

and the equivalent mass of the system is defined by:

$$Meq = M_{sprung} + 0.51\ m_{rubber}$$

The equation for the frequency of the system is as above described.

Alternatively, the body of the viscoelastic member 122 may be a thin slice of rubber wrapped around the strings 16 with the moveable member 124 in the center. The body has a center hole for the moveable member 124 with an end hole spaced on each side which is folded over a string 16 with the moveable member 124 passing through each end hole to hold the body on the moveable member 124. This will act as a tuned damper and effectively cancel the vibrations.

Referring now to FIGS. 7 through 12, a vibration damping device 210, according to the present invention, for a sporting implement is shown. The vibration damping device 210 is shown illustrated in conjunction with a sporting implement, such as a stringed racquet, generally indicated at 212. The stringed racquet 212 generally includes a racquet frame 213 having a head 214, strings 216, a throat 218 and a handle 220 disposed opposite the head 214, as is commonly known in the art. As illustrated in FIGS. 8 and 9, the racquet frame 213 has a reinforcement member 221 that divides the interior of the racquet frame 213 into two chambers. The vibration damping device 210 is disposed in one of the chambers to damp vibrations in the stringed racquet 212. It should be appreciated that the vibration damping device 210 may be employed to reduce vibration in any type of sporting implement such as a golf club or hockey stick but it is particularly adapted for use with tennis or racquet ball racquets.

The vibration damping device 210 is mounted in the handle 220 of the stringed racquet 212 and includes a base member 222 and a mass 224 mounted to the base member 222. The mass 224 is cantilevered relative to the base member 222. The mass 224 and base member 222 and their geometries are tuned such that the vibration damping device 210 vibrates at the same frequency as the sporting implement 212 but out of phase therewith. The mass 224 vibrates one hundred eighty degrees (180°) out of phase with the stringed racquet 212. The base member 222 acts to absorb the energy generated by the mass 224 and is released to the stringed racquet 212 to counteract energy produced in the stringed racquet 212 due to impact. The vibration damping device 210 also includes an encasement material 225 such as foam to substantially encase the mass 224. The encasement material 225 and base member 222 act in conjunction together to absorb the energy generated by the vibrating mass 224. When the vibration damping device 210 vibrates, the mass 224 creates a compression/tension type of movement in the base member 222 which, in turn, acts on the encasement material 225. The tension/compression motion acts simultaneously to reduce vibration in the handle 220 of the stringed racquet 212.

In one embodiment, the base member 222 has a body 236 with a substantially oval shape. The body 236 defines a shape so that the base member 222 fits snugly within the handle 220 of the stringed racquet 212. The base member 222 is made of a visco-elastic material such as rubber. The mass 224 is cylindrical in shape, defining a longitudinal axis 238 and an outer, radial, peripheral surface 240, such that the mass 224 is circular in cross-section. Further, the mass 224 has a pair of flat ends 242, 244 which are perpendicular to the longitudinal axis 238. The mass 224 extends from the oval body 236 of the base member 222. The mass 224 is made of a metal material such as brass. The encasement material 225 also has an oval shape and encloses a substantial portion of the outer radial peripheral surface 240 of the mass 224. The encasement material 225 is a foam material such as a high damping foam material. The properties of the base member 222, the mass 224 and encasement material 225, as well as torque applied to a fastener 254 to be described, are chosen such that the frequency of the vibration damping device 210 is comparable to that of the fundamental frequency of the sporting implement 212.

The base member 222 has an oval recess 246 and circular pocket 248 disposed opposite the recess 246 on the base member 222. One of the pair of circular, flat ends 242 of the mass 224 is received in the pocket 248. The base member 222 has an aperture 250 extending between the recess 246 and the pocket 248. The mass 224 includes a threaded aperture 252. The vibration damping device 210 includes a threaded fastener 254 extending through the aperture 250 in the base member 222 and received in the threaded aperture 252 of the mass 224 to mount the mass 224 to the base member 222. The fastener 254 is a bolt having a head 256 and a threaded shaft 258. The head 256 applies a clamping force on the base member 222 such that the vibration damping device 210 is tunable to the vibrational frequency of the stringed racquet 212 by adjusting the torque on the fastener 254. Compressing the base member 222 increases the stiffness thereof and hence the frequency of the vibration damping device 210. It should be appreciated that other suitable means may be provided to compress the base member 222 such as washers disposed in various slots along the mass 224 with a portion of the base member 222 disposed between the washers.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A stringed racquet having a vibration damping device, said stringed racquet comprising:

a racquet frame including a head and a handle;

said vibration damping device being mounted in said handle of said stringed racquet and including a viscoelastic base member and a mass mounted to said viscoelastic base member and cantilevered relative to said viscoelastic base member, said device being tuned such that it vibrates at the same frequency as said stringed racquet but out of phase therewith and said mass deforms said viscoelastic base member as a result of the vibrations, said viscoelastic base member acting to absorb energy generated by said mass and to release the absorbed energy to counteract energy produced in the stringed racquet due to impact; and a foam material substantially encasing said mass, said foam material and said viscoelastic base member acting in conjunction together to absorb the energy generated by said mass.

2. A stringed racquet having a vibration damping device, said stringed racquet comprising:

a racquet frame including a head and a handle;

said vibration damping device being mounted in said handle of said stringed racquet and including a viscoelastic base member and a mass mounted to said viscoelastic base member and cantilevered relative to said viscoelastic base member, said device being tuned such that it vibrates at the same frequency as said stringed racquet but out of phase therewith and said mass deforms said viscoelastic base member as a result of the vibrations, said viscoelastic base member acting to absorb energy generated by said mass and to release the absorbed energy to counteract energy produced in the stringed racquet due to impact; and wherein said viscoelastic base member has an aperture extending therethrough, said mass including a threaded aperture, said vibration damping device including a threaded fastener extending through said aperture in said viscoelastic base member and received in said threaded aperture of said mass to mount said mass to said viscoelastic base member.

3. A stringed racquet as set forth in claim 2 wherein said fastener comprises a bolt having a head and a threaded shaft, said head applying a clamping force on said viscoelastic base member such that said vibration damping device is tunable to the vibrational frequency of said stringed racquet by adjusting the torque on said fastener.

4. A stringed racquet having a vibration damping device, said stringed racquet comprising:

a racquet frame including a head and a handle;

said vibration damping device being mounted in said handle of said stringed racquet and including a viscoelastic base member and a mass mounted to said viscoelastic base member and cantilevered relative to said viscoelastic base member, said device being tuned such that it vibrates at the same frequency as said stringed racquet but out of phase therewith and said mass deforms said viscoelastic base member as a result of the vibrations, said viscoelastic base member acting to absorb energy generated by said mass and to release the absorbed energy to counteract energy produced in the stringed racquet due to impact; and wherein said viscoelastic base member has an oval shape, said mass being cylindrical in shape, defining a longitudinal axis and an outer radial, peripheral surface such that said mass is circular in cross-section and has a pair of flat ends which are perpendicular to said longitudinal axis, said mass extending from said oval viscoelastic base member.

5. A stringed racquet as set forth in claim 4 wherein said viscoelastic base member has a pocket disposed on said viscoelastic base member, one of said pair of flat ends of said mass being received in said pocket.

6. A stringed racquet as set forth in claim 5 wherein said viscoelastic base member has an aperture extending between said recess and said pocket, said mass including a threaded aperture, said vibration damping device including a threaded fastener extending through said aperture in said viscoelastic base member and received in said threaded aperture of said mass to mount said mass to said viscoelastic base member.

7. A stringed racquet as set forth in claim 4 including a foam material disposed about a substantial portion of said outer radial peripheral surface of said mass.

* * * * *